US011088491B2

(12) United States Patent
Ikeya et al.

(10) Patent No.: US 11,088,491 B2
(45) Date of Patent: Aug. 10, 2021

(54) HOUSING WITH LOCK PIECE

(71) Applicant: YAZAKI CORPORATION, Tokyo (JP)

(72) Inventors: Kazuhide Ikeya, Makinohara (JP); Hikaru Anma, Makinohara (JP); Sho Kasuya, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/865,265

(22) Filed: May 1, 2020

(65) Prior Publication Data

US 2020/0388958 A1 Dec. 10, 2020

(30) Foreign Application Priority Data

Jun. 4, 2019 (JP) ..... JP2019-104716

(51) Int. Cl.
*H01R 13/506* (2006.01)
*H01R 13/627* (2006.01)
*H01R 13/639* (2006.01)

(52) U.S. Cl.
CPC ..... *H01R 13/6272* (2013.01); *H01R 13/506* (2013.01); *H01R 13/639* (2013.01)

(58) Field of Classification Search
CPC . H01R 13/6272; H01R 13/506; H01R 13/639
See application file for complete search history.

(56) References Cited

U.S. PATENT DOCUMENTS

| | | | | |
|---|---|---|---|---|
| 7,632,138 | B2 | 12/2009 | Hiramatsu | |
| 9,022,798 | B2 * | 5/2015 | Kida | H01R 13/6272 439/358 |
| 2003/0096527 | A1 * | 5/2003 | Greiner | H01R 13/6272 439/352 |
| 2013/0323949 | A1 * | 12/2013 | De Dios Martin | H01R 13/6335 439/160 |
| 2015/0056846 | A1 | 2/2015 | Kataoka et al. | |
| 2016/0248188 | A1 * | 8/2016 | Upson | H01R 13/4361 |
| 2018/0048092 | A1 * | 2/2018 | Graham | H01R 13/639 |

FOREIGN PATENT DOCUMENTS

| | | | |
|---|---|---|---|
| CN | 104425957 | A | 3/2015 |
| JP | 9-139249 | A | 5/1997 |
| JP | 2006-127796 | A | 5/2006 |
| JP | 2015-26557 | A | 2/2015 |
| JP | 2015-210967 | A | 11/2015 |

* cited by examiner

*Primary Examiner* — Tho D Ta
(74) *Attorney, Agent, or Firm* — Kenealy Vaidya LLP

(57) ABSTRACT

A housing includes a housing main body configured to be fitted with a mating housing, and a cover configured to be mounted to an end portion of the housing main body from which an electric wire is drawn out and to cover the electric wire drawn out from the housing main body. The housing main body includes a lock arm for locking a protruding portion of the mating housing, and a release arm that swings when an operation portion of the release arm is pressed to release a locking of the protruding portion and the lock arm. The cover has a lock piece that is interposed between the housing main body and the operation portion when the cover is mounted to the housing main body so as to restrict a swing of the release arm.

6 Claims, 5 Drawing Sheets

HOUSING WITH LOCK PIECE

CROSS REFERENCE TO RELATED APPLICATIONS

This application is based on Japanese Patent Application (No. 2019-104716) filed on Jun. 4, 2019, the contents of which are incorporated herein by reference.

BACKGROUND OF THE INVENTION

1. Field of the Invention

The present invention relates to a housing.

2. Description of the Related Art

A housing fitted to a mating housing includes a lock mechanism to be locked with a lock protrusion of the mating housing (for example, see JP-A-2006-127796). Further, there is known a connector with a cover which has an upper cover and a lower cover assembled in an upper-lower direction of a housing to cover the periphery of the housing, and to guide electric wires (for example, see JP-A-2015-210967). Further, there is also known a connector provided with a belt-shaped cover integrally formed with a housing. The cover is bent to insert and lock an end portion of the cover into a space below a lock arm (for example, see JP-A-2015-26557).

In the housing including the lock mechanism which is described in JP-A-2006-127796, there is a possibility that the lock with the mating housing may be released by unintentional operation of the lock mechanism. On the other hand, in the housing described in JP-A-2015-210967, the entire housing is covered with the cover, so that unintentional release of the lock mechanism can be prevented. However, the size of the entire housing is increased. Further, in the housing described in JP-A-2015-26557, since the belt-shaped cover is integrally formed with the housing, a molding die has a special and complicated shape, and the manufacturing cost for the housing increases.

SUMMARY

The present invention has been made in view of the above circumstances, and an object thereof is to provide a housing capable of maintaining a lock with a mating housing by a lock mechanism without increasing the size of the housing, and capable of preventing an increase in the manufacturing cost.

In order to achieve the above object, the housing according to the present invention is characterized by the following (1) to (4).

(1) There is provided a housing including:

a housing main body configured to be fitted with a mating housing; and a cover configured to be mounted to an end portion of the housing main body from which an electric wire is drawn out and to cover the electric wire drawn out from the housing main body, in which the housing main body includes a lock arm for locking a protruding portion of the mating housing, and a release arm that swings when an operation portion of the release arm is pressed to release a locking of the protruding portion and the lock arm, and in which the cover has a lock piece that is interposed between the housing main body and the operation portion when the cover is mounted to the housing main body so as to restrict a swing of the release arm.

(2) The housing according to the above item (1), in which a finger contact portion is provided on the housing main body at a side opposite to the operation portion in a direction perpendicular to a fitting direction in which the housing main body is fitted with the mating housing;

in which an engagement portion to be engaged with the finger contact portion is provided on the cover; and in which the cover is mounted to the housing main body by being rotated toward a housing main body around an engagement position of the finger contact portion and the engagement portion, with the lock piece being interposed between the housing main body and the operation portion.

(3) The housing according to the above item (1) or (2), in which locking portions to be locked with both side portions of the cover are provided on both side portions of the housing main body.

(4) The housing according to any one of the above items (1) to (3), in which when an attachment portion of the cover is mounted to the housing main body, the attachment portion does not protrude from an outer shape of the housing main body in a front view of the housing main body.

According to the housing having the configuration of the item (1), the cover is mounted to the housing main body, so that it is possible to cover and protect the electric wires drawn out from the housing main body. In addition, the cover, which is separate from the housing main body, is mounted to the end portion of the housing main body on the electric wire drawing side, so that there is no increase in size and in manufacturing cost as compared with a housing provided with a cover that covers the entire periphery or a housing integrally formed with a cover. When the cover is mounted, the lock piece of the cover is interposed between the housing main body and the operation portion. As a result, it is possible to prevent the locked state to the protruding portion from being released by the lock arm due to the operation portion being inadvertently pushed. In addition, when the fitted state of the housing main body to the mating housing is incomplete, the lock piece interferes with the operation portion, and therefore, it is difficult to mount the cover to the housing main body. Accordingly, the operator can easily recognize that the fitting of the housing main body to the mating housing is incomplete.

According to the housing having the configuration of the item (2), the cover can be easily mounted to the housing main body by engaging the engagement portion with the finger contact portion of the housing main body and rotating the cover. Then, the cover is mounted to the housing main body, so that the lock piece is interposed between the housing main body and the operation portion, and the lock of the protruding portion can be prevented from being released by the lock arm.

According to the housing having the configuration of the item (3), when the cover is mounted to the housing main body, the locking portions provided on both side portions of the housing main body lock both side portions of the cover. As a result, the cover can be maintained in a state in which the cover is properly mounted to the housing main body.

According to the housing having the configuration of the item (4), the attachment portion of the cover is mounted to the housing main body without protruding from the outer shape of the housing main body in a front view of the housing main body, so that a housing including a cover without an increase in size can be provided.

According to the present invention, it is possible to provide a housing capable of maintaining a lock with a mating housing by a lock mechanism without increasing the size of the housing, and capable of preventing an increase in the manufacturing cost.

The present invention is briefly described as above. Further, details of the present invention will be clarified by reading a mode (hereinafter, referred to as "embodiment") for carrying out the invention to be described below with reference to the accompanying drawings.

BRIEF DESCRIPTION OF DRAWINGS

FIGS. 3A and 3B are views illustrating the female housing, in which FIG. 3A is a perspective view of an upper portion of the female housing as viewed from a rear side, and FIG. 3B is a perspective view of a lower portion of the female housing as viewed from the rear side.

FIGS. 5A and 5B are view showing a housing main body and the cover, in which FIG. 5A is a cross-sectional view along the longitudinal direction when the cover is mounted, and FIG. 5B is a cross-sectional view along the longitudinal direction before the cover is mounted.

DESCRIPTION OF EXEMPLARY EMBODIMENTS

Hereinafter, an embodiment according to the present invention will be described with reference to the drawings.

Figure 1:
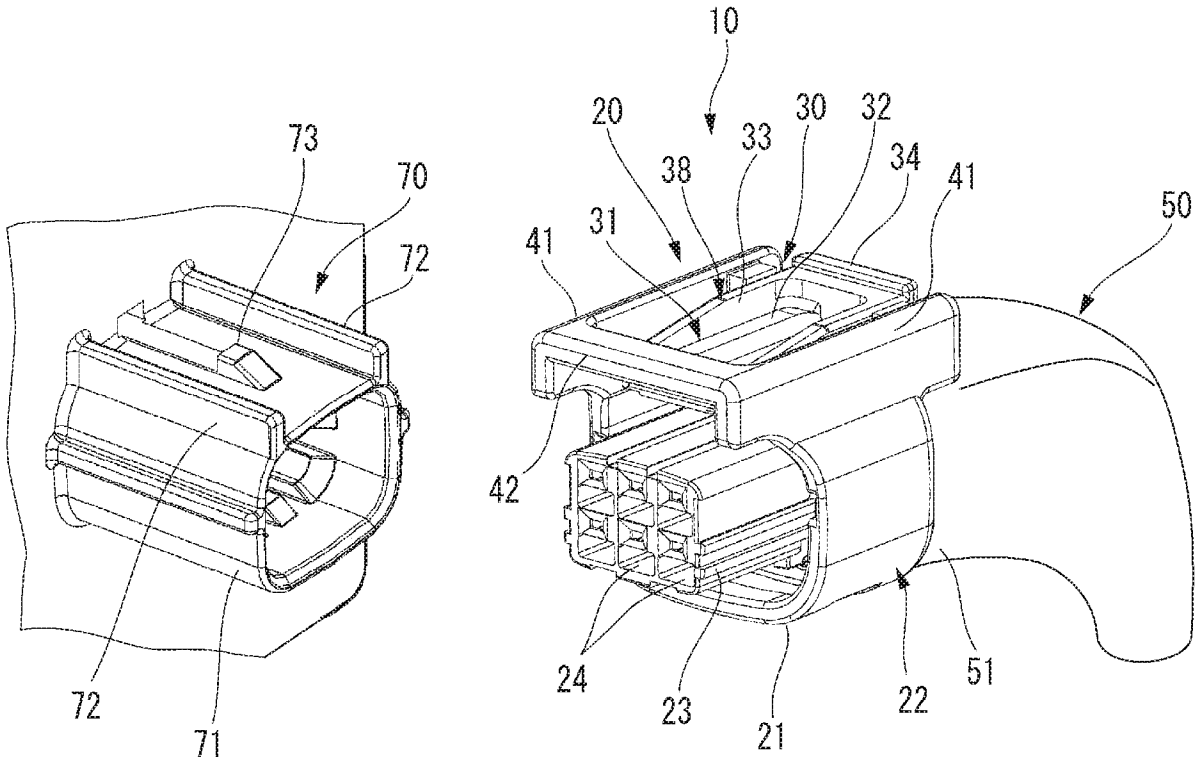
FIG. 1 is a perspective view of a female housing according to the present embodiment and a male housing.

FIG. 1 is a perspective view of a female housing according to the present embodiment and a mating housing.

As shown in FIG. 1, a female housing (housing) 20 according to the present embodiment and a male housing (mating housing) 70 configure a connector 10.

The female housing 20 includes a housing main body 22 in which a hood portion 21 is formed, and a cover 50 assembled to the housing main body 22. The male housing 70 includes a connection portion 71. The female housing 20 and the male housing 70 are joined to each other by fitting the hood portion 21 of the housing main body 22 and the connection portion 71.

The male housing 70 is formed of a synthetic resin. A plurality of male terminals (not shown) is provided in the male housing 70, and these male terminals are disposed in the connection portion 71.

The male housing 70 has a pair of guiding ridges 72 and a protruding portion 73 which are provided on an upper part of the connection portion 71. The guiding ridges 72 are formed along a direction in which the male housing 70 is fitted with the female housing 20 (hereinafter, simply referred to as fitting direction), and are spaced apart from each other. The protruding portion 73 is formed at a center position in a width direction on the upper part of the connection portion 71 and is arranged between the pair of guiding ridges 72. The protruding portion 73 protrudes from an upper surface of the connection portion 71, and is formed with, on a leading side in the fitting direction, a guide surface 74 that is gradually inclined upward toward a rear end side of the male housing 70.

Figure 2:
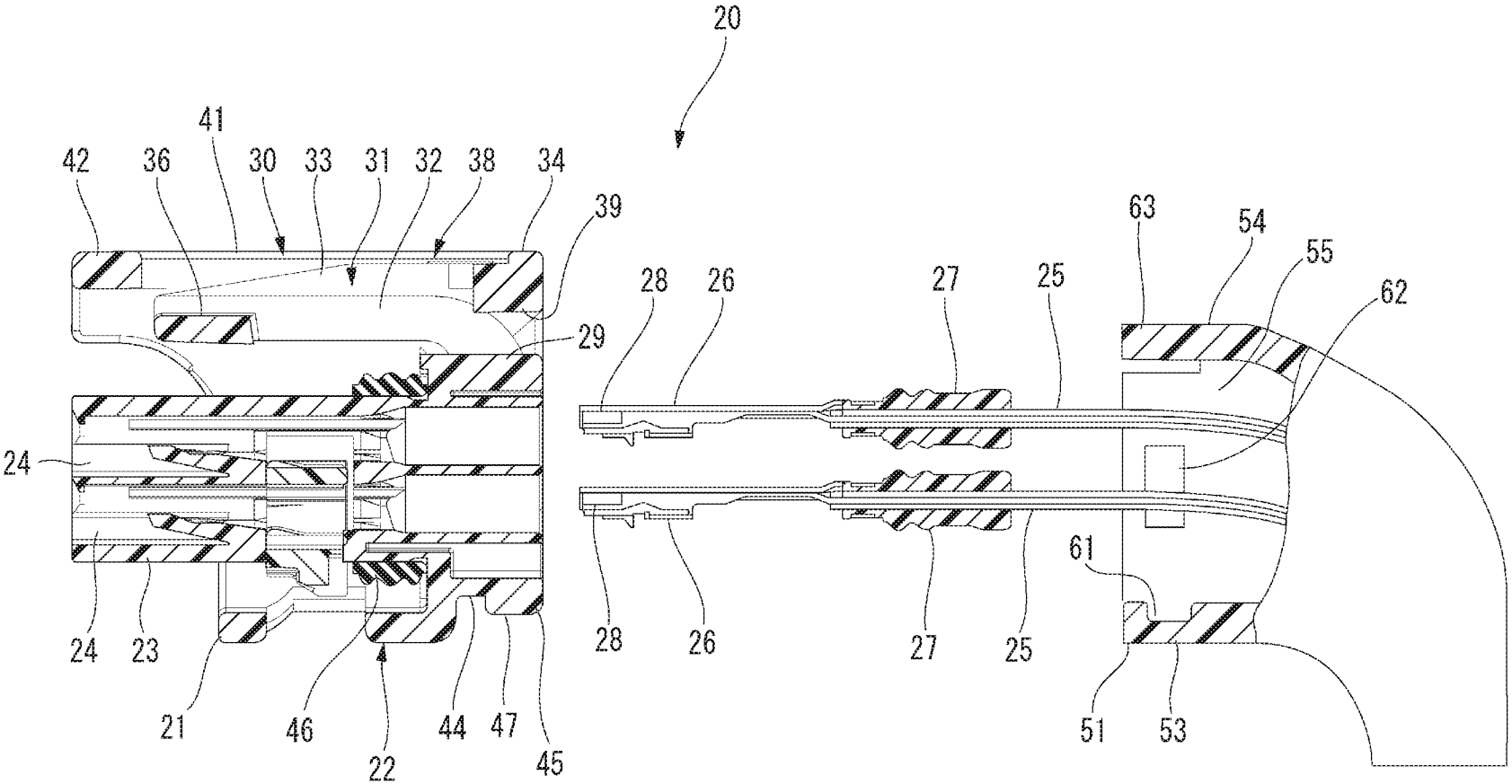
FIG. 2 is a cross-sectional view of the female housing along a longitudinal direction.

FIG. 2 is a cross-sectional view of the female housing along a longitudinal direction.

As shown in FIG. 2, the hood portion 21 provided in the housing main body 22 of the female housing 20 has a tubular shape. The female housing 20 is formed of a synthetic resin, and the housing main body 22 has a fitting portion 23 inside the hood portion 21. The fitting portion 23 has a plurality of terminal accommodating chambers 24 which are provided to protrude in a direction in which the female housing 20 is fitted with the male housing 70 (hereinafter, simply referred to as fitting direction).

An annular seal member 46 that seals a fitting portion with the male housing 70 is inserted from a tip end side of the fitting portion 23 and is mounted at a base of the fitting portion 23. The seal member 46 is formed of, for example, an elastic material such as rubber, and is in close contact with the connection portion 71 of the male housing 70 fitted to the hood portion 21 of the female housing 20. Therefore, the fitting portion of the male housing 70 and the female housing 20 is sealed by the seal member 46.

Female terminals 26 connected to end portions of electric wires 25 are respectively accommodated in the terminal accommodating chambers 24 of the fitting portions 23, and the electric wires 25 are drawn out from a rear end of the housing main body 22. A rubber stopper 27 attached to the electric wire 25 is fitted into the terminal accommodating chamber 24 from the rear end side of the housing main body 22. Accordingly, the terminal accommodating chambers 24 of the housing main body 22 in which the female terminals 26 are accommodated are sealed.

The female terminal 26 is formed of, for example, a conductive metal material such as copper or a copper alloy, and is connected to the electric wire 25 by crimping. The female terminal 26 includes an electrical connection portion 28 formed in a tubular shape.

Figure 3A:
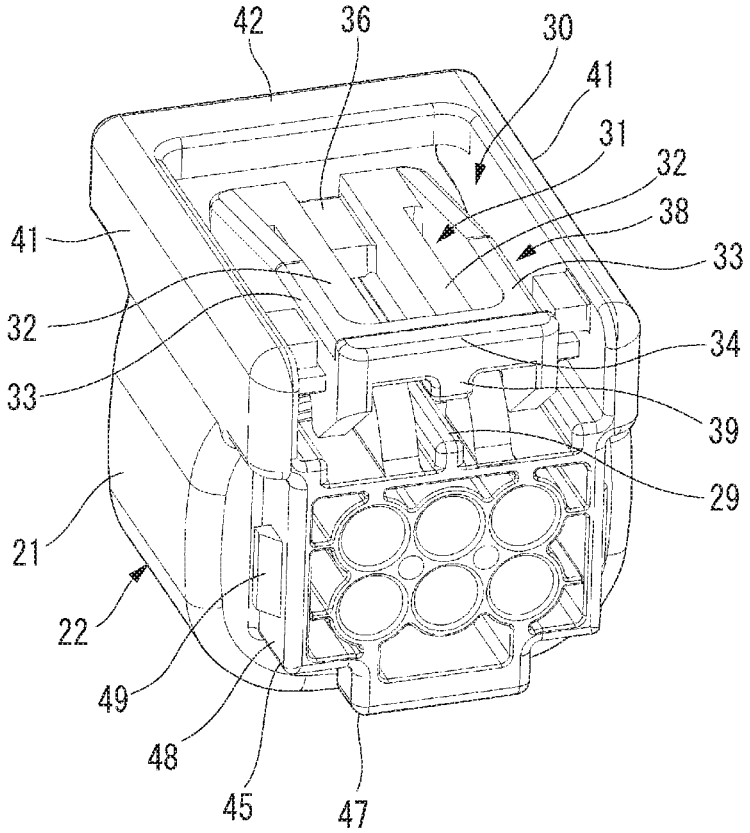
Figure 3B:
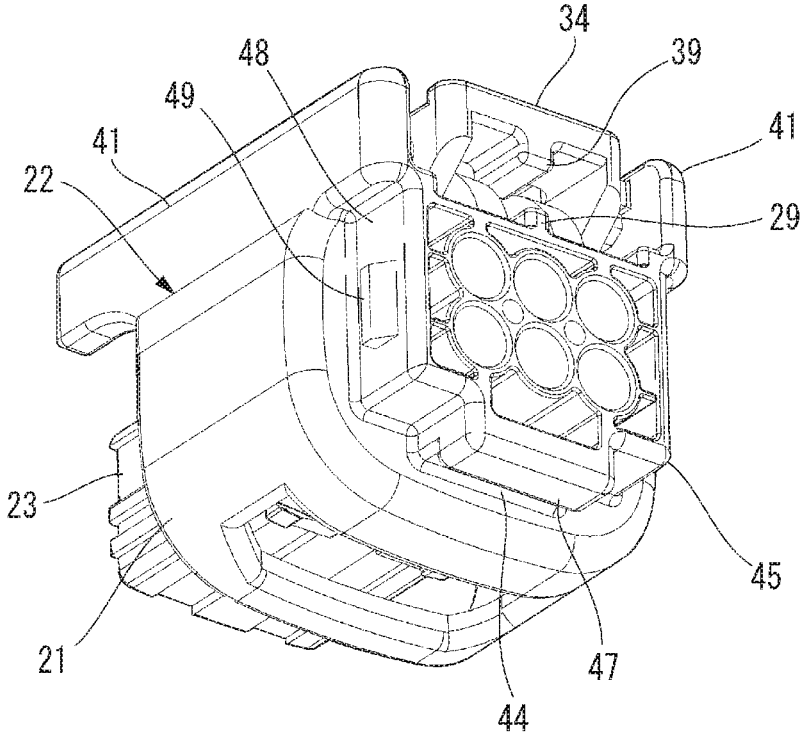

FIGS. 3A and 3B are views illustrating the female housing, in which FIG. 3A is a perspective view of an upper portion of the female housing as viewed from the rear side, and FIG. 3B is a perspective view of a lower portion of the female housing as viewed from the rear side.

As shown in FIGS. 3A and 3B, a lock mechanism 30 is provided on the upper portion of the housing main body 22 in the female housing 20. The lock mechanism 30 includes a lock arm 31 and a release arm 38.

The lock arm 31 includes a pair of elastic arm portions 32 and a locking portion 36. The pair of elastic arm portion 32 is formed in a cantilevered support beam shape that is connected to the housing main body and extends toward the leading side in the fitting direction. The pair of elastic arm portions 32 is arranged in parallel and spaced apart from each other. The pair of elastic arm portions 32 is connected with each other at the leading side in the fitting direction. In the lock arm 31, a connecting portion of the elastic arm portions 32 which are connected to each other is the locking portion 36, and the locking portion 36 is formed on the male housing 70 and is disengaged from or engaged with the protruding portion 73.

The release arm 38 includes a pair of support arm portions 33 and an operation portion 34. The pair of support arm portions 33 is provided on an outer side of the pair of elastic arm portions 32, respectively. End portions of the support arm portions 33 on the leading side in the fitting direction are connected to the elastic arm portions 32 and extend toward a rear side in the fitting direction. Rear end portions of the support arm portions 33 are connected on a side opposite to the side on which the elastic arm portion 32 is connected, and the connecting portion is the operation portion 34.

A pair of protective walls 41 is provided on both side portions of the lock mechanism 30. These protective walls 41 are erected on the upper portion of the housing main body 22, and the lock mechanism 30 is protected by being surrounded on the sides by the protective walls 41. A beam portion 42 is provided on the leading side in the fitting direction of the protective walls 41. Both ends of the beam portion 42 are connected to the protective walls 41, and the beam portion 42 is spaced apart from the housing main body 22.

The housing main body 22 has a protrusion 29 protruding toward the operation portion 34. Further, the operation portion 34 arranged at rear ends of the support arm portions 33 of the release arm 38 has a protrusion 39 protruding toward the housing main body 2'. The protrusion 29 and the protrusions 39 are formed at the center position of the female housing 20 in the width direction. In the female housing 20, when the operation portion 34 is pressed down more than necessary by an operator, the protrusion 29 of the housing main body 22 comes into contact with the protrusion 39 of the operation portion 34, so that breakage or damage of the lock mechanism 30 due to excessive displacement of the support arm portions 33 is prevented.

Further, the housing main body 22 has a cover mounting portion 45 protruding rearward at the rear end, that is, on an electric wire drawing side from which the electric wires are drawn out. The cover mounting portion 45 has a bottom surface portion 44 and side surface portions 48. A finger contact portion 47 made of a ridge is provided on the bottom surface portion 44. The finger contact portion 47 is a portion on which an operator puts a finger when pressing the operation portion 34 of the release arm 38. Thus, the operator can press down the operation portion 34 with the thumb, for example, while holding the finger contact portion 47 with the index finger of the operator. Further, a locking claw (locking portion) 49 is provided on each of the side surface portions 48.

Figure 4:
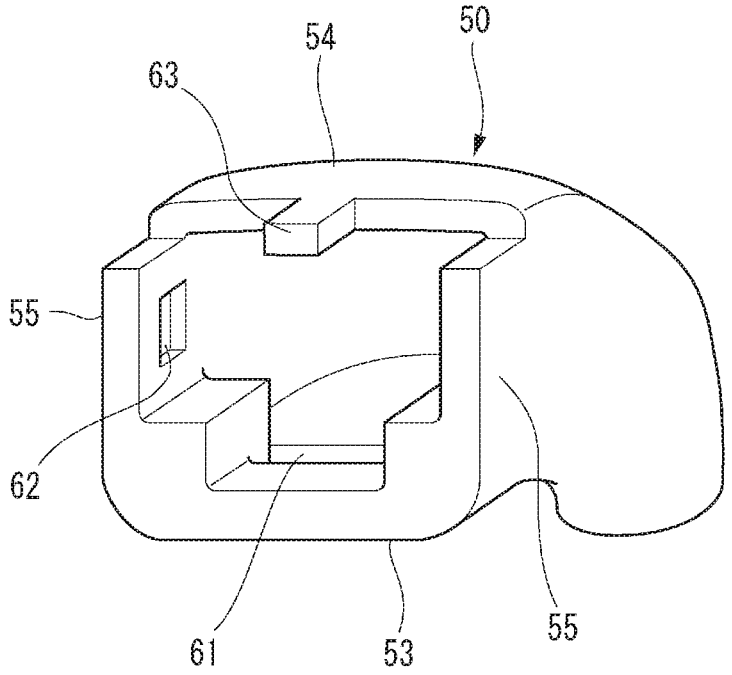
FIG. 4 is a perspective view of a cover as viewed from an attachment portion side of the cover.
Figure 5A:
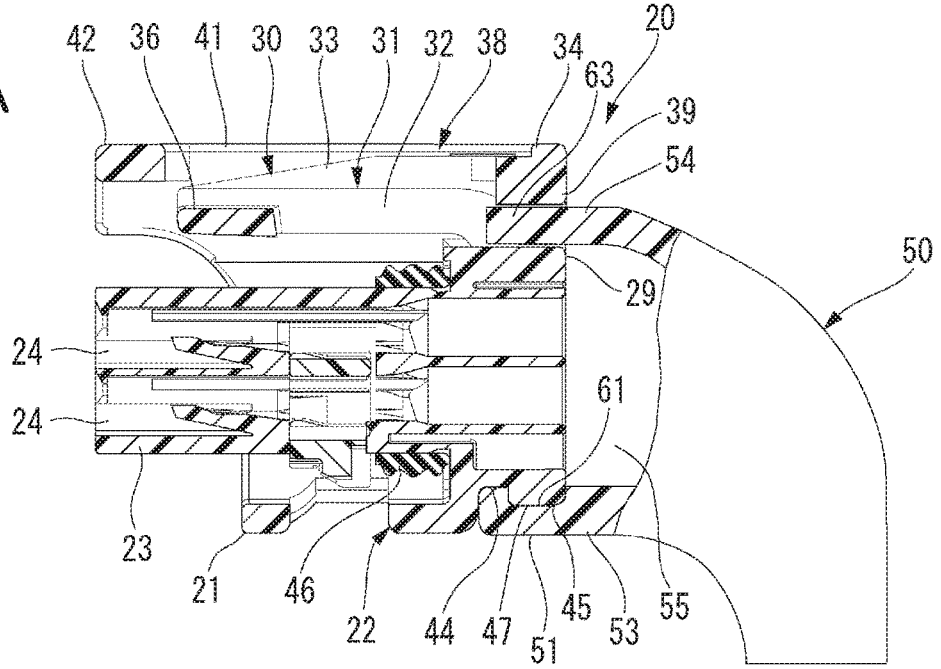
Figure 5B:
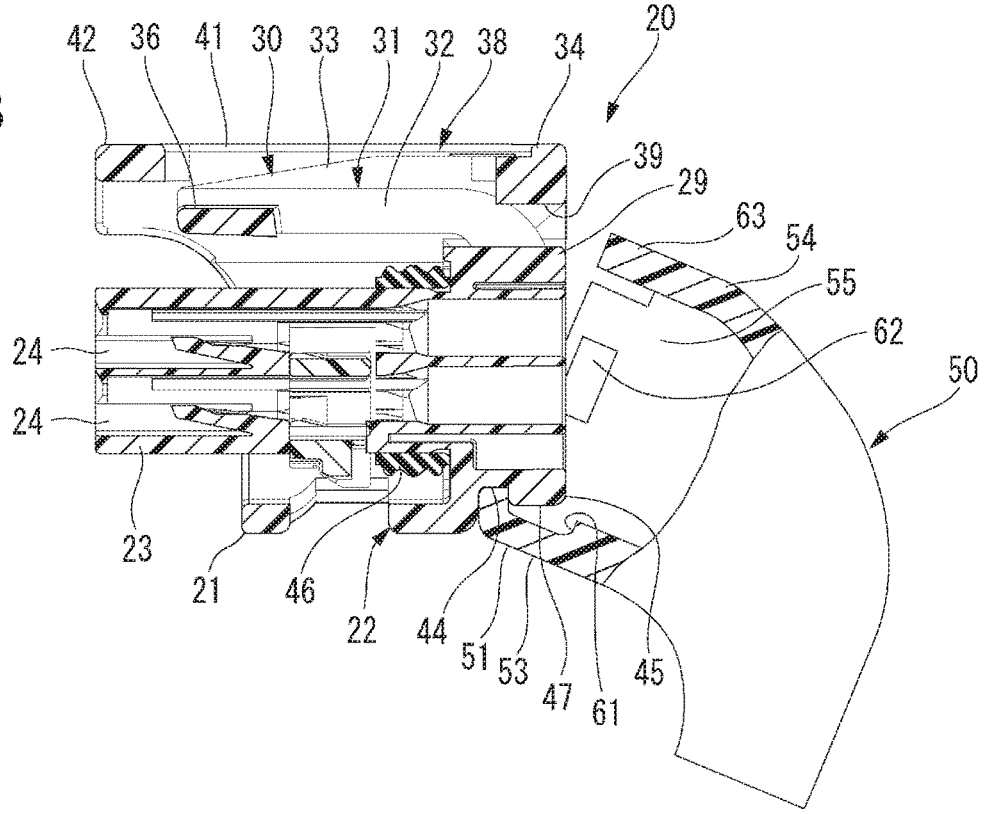

FIG. 4 is a perspective view of the cover as viewed from an attachment portion side of the cover. FIGS. 5A and 5B are views showing the housing main body and the cover, in which FIG. 5A is a cross-sectional view along the longitudinal direction when the cover is mounted, and FIG. 5B is a cross-sectional view along the longitudinal direction before the cover is mounted.

As shown in FIGS. 2 and 4, the cover 50 is formed in a bent tubular shape, and the electric wires 25 drawn from the rear end, which is the end of the housing main body 22 on the electric wire drawing side, are passed through the inside of the cover 50. Therefore, the electric wires 25 drawn out of the housing main body 22 are protected by the cover 50. The cover 50 is gradually narrowed while bending from one end to the other end. The cover 50 is integrally formed of a synthetic resin such as rubber, for example.

One end of the cover 50 is mounted on the cover mounting portion 45 of the housing main body 22. The one end of the cover 50 mounted on the cover mounting portion 45 has an attachment portion 51 formed with an inner shape thereof having a shape corresponding to an outer shape of the cover mounting portion 45. The attachment portion 51 is formed in a substantially rectangular shape in a front view having a bottom wall portion 53, an upper wall portion 54, and side wall portions 55.

An engagement groove (engagement portion) 61 is formed in the bottom wall portion 53. The engagement groove 61 is formed on an inner surface near an edge of the bottom wall portion 53. Further, a locking hole 62 is formed in each of the side wall portions 55. The locking hole 62 is formed on an inner surface near an edge of each of the side wall portions 55. The upper wall portion 54 has a cutout edge, and a lock piece 63 is formed at the edge. The lock piece 63 is formed at the center position of the cover 50 in the width direction, and protrudes toward a mounting direction to the housing main body 22.

As shown in FIG. 5A, in a state where the attachment portion 51 is mounted on the cover mounting portion 45 of the housing main body 22, in the cover 50, the finger contact portion 47 is engaged with the engagement groove 61 of the bottom wall portion 53, and the locking claws 49 are locked in the locking holes 62 of the side wall portions 55. As a result, the state where the cover 50 is mounted to the housing main body 22 is maintained. In this mounted state, the lock piece 63 of the cover 50 is interposed between the protrusion 29 of the housing main body 22 and the protrusion 39 of the operation portion 34 of the release arm 38. Thus, the swing of the support aria portions 33 of the release arm 38 is restricted. In the mounted state of the cover 50, the attachment portion 51 of the cover 50 falls within a range of an outer shape of the housing main body 22 when the housing main body 22 is viewed from the front. That is, when the cover 50 is mounted to the housing main body 22, the attachment portion 51 does not protrude from the outer shape of the housing main body 22 in view from the front.

In order to mount the cover 50 to the cover mounting portion 45 of the housing main body 22, first, as shown in FIG. 5B, the engagement groove 61 provided on the bottom wall portion 53 of the attachment portion 51 of the cover 50 is engaged with the finger contact portion 47. Then, the cover 50 is rotated toward the housing main body 22 around an engagement position of the engagement groove 61 and the finger contact portion 47. Then, the cover mounting portion 45 of the housing main body 22 is fitted into the attachment portion 51 of the cover 50, and the locking claws 49 are inserted into the locking holes 62 and locked. Further, the lock piece 63 of the cover 50 is inserted between the protrusion 29 of the housing main body 22 and the protrusion 39 of the operation portion 34 of the release arm 38.

Next, a case where the female housing 20 is fitted to the male housing 70 will be described.

The fitting portion 23 is fitted to the connection portion 71 of the male housing 70 by bringing the hood portion 21 of the female housing 20 before the cover 50 is attached close to the connection portion 71. Then, the lock mechanism 30 is guided by the guiding ridges 72 of the male housing 70, and the locking portion 36 of the lock arm 31 of the female housing 20 comes into contact with the guide surface 74 of the protruding portion 73 of the male housing 70.

When the female housing 20 is pushed into the male housing 70, the locking portion 36 of the lock arm 31 that is in contact with the guide surface 74 of the protruding portion 73 slides along the guide surface 74 and starts to ride, and the elastic arm portion 32 of the lock arm 31 is elastically deformed. As a result, the support arm portion 33 of the release arm 38 swings when a front end side connected to the elastic arm portion 32 is displaced away from the housing main body 22.

When the locking portion 36 climbs over the protruding portion 73 by further pushing the female housing 20 into the male housing 70, the elastic arm portion 32 that is elastically deformed is restored, the support arm portion 33 swings in a reverse direction, and the locking portion 36 enters the leading side in the fitting direction of the protruding portion 73 and is locked. Thus, the female housing 20 is locked with the male housing 70 while being fitted. In this fitted state, the connection portion 71 of the male housing 70 is in close contact with the seal member 46 mounted to the fitting portion 23 of the female housing 20, and the fitting portion of the male housing 70 and the female housing 20 is sealed. Then, in this fitted state, the male terminal is inserted into the electrical connection portion 28 of the female terminal 26, so that the female terminal 26 and the male terminal are electrically connected.

When the female housing 20 is fitted to the male housing 70, the cover 50, through Which the electric wires 25 are passed in advance, is attached to the housing main body 22. Then, the lock piece 63 of the cover 50 is inserted and interposed between the protrusion 29 of the housing main body 22 and the protrusion 39 of the operation portion 34 of the release arm 38. As a result, the swing of the support arm portion 33 of the release arm 38 is restricted, and it is possible to prevent the locked state of the locking portion 36 of the lock arm 31 being released from the protruding portion 73 of the male housing 70 due to the operation portion 34 being inadvertently pushed and the release arm 38 being swung.

In an operation of mounting the cover 50 to the housing main body 22, when the release arm 38 of the lock mechanism 30 is inclined due to the incompletely fitted state of the male housing 70 and the female housing 20, the lock piece 63 of the cover 50 to be mounted on the housing main body 22 interferes with the operation portion 34 of the support arm portion 33 of the release arm 38. As a result, the cover 50 cannot be mounted to the housing main body 22. Accordingly, the operator can easily recognize that the fitting of the housing main body 22 of the female housing 20 to the male housing 70 is incomplete.

Next, a case where the female housing 20 is detached from the male housing 70 will be described.

In order to detach the female housing 20 from the male housing 70, first, the cover 50 is removed from the housing main body 22. Then, the lock piece 63 of the cover 50 is pulled out from between the protrusion 29 of the housing main body 22 and the protrusion 39 of the operation portion 34 of the release arm 38, and the release arm 38 can swing. Then, the operation portion 34 at the rear end of the release arm 38 that becomes swingable is pressed toward the housing main body 22 side.

Then, the support arm portion 33 is swung, the locking portion 36 of the lock arm 31 is displaced in a direction away from the housing main body 22, the locking of the locking portion 36 to the protruding portion 73 is released, and the lock of the female housing 20 to the male housing 70 is released.

In this state, the female housing 20 is moved in a direction in which the female housing 20 is separated from the male housing 70. Accordingly, the female housing 20 is detached from the male housing 70, and the electrical connection between the female terminal 26 and the male terminal is released.

As described above, according to the female housing 20 of the present embodiment, the cover 50 is mounted to the housing main body 22, so that it is possible to cover and protect the electric wires 25 drawn out from the housing main body 22. In addition, the cover 50, which is separate from the housing main body 22, is mounted to the end portion of the housing main body 22 on the electric wire drawing side, so that there is no increase in size and in manufacturing cost as compared with a housing provided with a cover that covers the entire periphery or a housing integrally formed with a cover. When the cover 50 is mounted, the lock piece 63 of the cover 50 is interposed between the housing main body 22 and the operation portion 34. As a result, it is possible to prevent the locked state of the protruding portion 73 by the lock arm 31 from being released due to the operation portion 34 being inadvertently pushed. In addition, when the fitted state of the housing main body 22 to the male housing 70 is incomplete, the lock piece 63 interferes with the operation portion 34, and therefore, it is difficult to mount the cover 50 to the housing main body 22. Accordingly, the operator can easily recognize that the fitting of the housing main body 22 to the male housing 70 is incomplete.

The cover 50 can be easily mounted to the housing main body 22 by engaging the engagement groove 61 of the cover 50 with the finger contact portion 47 of the housing main body 22 and rotating the cover 50. Then, the cover 50 is mounted to the housing main body 22, so that the lock piece 63 is interposed between the housing main body 22 and the operation portion 34, and the lock of the protruding portion 73 by the lock arm 31 can be prevented from being released.

Further, when the cover 50 is mounted to the housing main body 22, the locking claws 49 provided on both side portions of the housing main body 22 lock both side portions of the cover 50. As a result, the cover 50 can be maintained in a state in which the cover 50 is properly mounted to the housing main body 22.

Further, when the attachment portion 51 of the cover 50 is mounted to the housing main body 22, the attachment portion 51 does not protrude from the outer shape of the housing main body 22 in a front view of the housing main body 22, so that the housing including the cover without an increase in size can be provided.

The present invention is not limited to the embodiment described above, and modifications, improvements, or the like can be made as appropriate. In addition, materials, shapes, dimensions, numbers, arrangement locations and the like of elements in the above embodiment are optional and not limited as long as the object of the present invention can be achieved.

Here, characteristics of the housing according to the embodiment of the present invention described above will be briefly summarized in the following [1] to [4], respectively.

[1] A housing (female housing 20) including:

a housing main body (22) configured to be fitted with a mating housing (male housing 70): and a cover (50) configured to be mounted to an end portion of the housing main body from which an electric wire is drawn out and to cover the electric wire (25) drawn out from the housing main body (22), in which the housing main body (22) includes a lock arm (31) for locking a protruding portion (73) of the mating housing (male housing 70), and a release arm (38) that swings when an operation portion (34) of the release arm is pressed to release a locking of the protruding portion (73) and the lock arm (31): and the cover (50) has a lock piece (63) that is interposed between the housing main body (22) and the operation portion (34) when the cover (50) is mounted to the housing main body (22) so as to restrict a swing of the release arm (38).

[2] In the housing according to [1], a finger contact portion (47) is provided on the housing main body (22) at a side opposite to the operation portion (34) in a direction perpendicular to a fitting direction in which the housing main body (22) is fitted with the mating housing (male housing 70), an engagement portion (engagement groove 61) to be engaged with the finger contact portion (47) is provided on the cover (50); and the cover (50) is mounted to the housing main body (22) by being rotated toward a housing main body (22) around an engagement position of the finger contact portion (47) and the engagement portion (engagement groove 61), with the lock piece (63) being interposed between the housing main body (22) and the operation portion (34).

[3] In the housing according to [1] or [2], locking portions (locking claws 49) to be locked with both side portions of the cover (50) are provided on both side portions of the housing main body (22).

[4] In the housing according to any one of [1] to [3], when an attachment portion (51) of the cover (50) is mounted to the housing main body (22), the attachment portion (51) does not protrude from an outer shape of the housing main body (22) in a front view of the housing main body (22).

What is claimed is:

1. A housing comprising:

a housing main body configured to be fitted with a mating housing; and a cover configured to be mounted to an end portion of the housing main body from which an electric wire is drawn out and to cover the electric wire drawn out from the housing main body, wherein the housing main body includes a lock arm for locking a protruding portion of the mating housing, and a release arm that swings from a locking position to a releasing position when an operation portion of the release arm is pressed to release a locking of the protruding portion and the lock arm; and wherein the cover has a lock piece that is interposed between the housing main body and the operation portion when the cover is mounted to the housing main body so as to prevent a swing of the release arm from the locking position to the releasing position.

2. The housing according to claim 1, wherein a finger contact portion is provided on the housing main body at a side opposite to the operation portion in a direction perpendicular to a fitting direction in which the housing main body is fitted with the mating housing;

wherein an engagement portion to be engaged with the finger contact portion is provided on the cover; and wherein the cover is mounted to the housing main body by being rotated toward a housing main body around an engagement position of the finger contact portion and the engagement portion, with the lock piece being interposed between the housing main body and the operation portion.

3. The housing according to claim 1, wherein locking portions to be locked with both side portions of the cover are provided on both side portions of the housing main body.

4. The housing according to claim 1, wherein when an attachment portion of the cover is mounted to the housing main body, the attachment portion does not protrude from an outer shape of the housing main body in a front view of the housing main body.

5. The housing according to claim 2, wherein the cover has side wall portions with locking holes, the main body has locking portions that engage the locking holes, and the engagement portion, of the cover, is spaced away from the locking holes.

6. The housing according to claim 1, wherein the cover has an upper wall portion with a cutout edge, the lock piece is formed at the cutout edge, and the lock piece extends from the upper wall portion in the fitting direction.

* * * * *